United States Patent [19]

Cheron et al.

[11] Patent Number: 4,625,522

[45] Date of Patent: Dec. 2, 1986

[54] PROCESS FOR PRODUCING COLD AND/OR HEAT BY USING A NON-AZEOTROPIC MIXTURE OF FLUIDS IN A CYCLE WITH EJECTOR

[75] Inventors: Jacques Cheron, Maisons Laffitte; Alexandre Rojey, Garches, both of France

[73] Assignee: Institut Francais du Petrole, Rueil Malmaison, France

[21] Appl. No.: 817,386

[22] Filed: Jan. 9, 1986

[30] Foreign Application Priority Data

Jan. 9, 1985 [FR] France ..... 85 00330

[51] Int. Cl.[4] ..... F25B 1/00

[52] U.S. Cl. ..... 62/114; 62/116; 62/500

[58] Field of Search ..... 62/116, 500, 114, 118

[56] References Cited

U.S. PATENT DOCUMENTS

| | | | |
|---|---|---|---|
| 2,931,190 | 4/1960 | Dubitzky | 62/114 |
| 3,277,660 | 10/1966 | Kemper et al. | 62/116 |
| 4,438,633 | 3/1984 | Hiser | 62/500 X |
| 4,532,773 | 8/1985 | Rojey et al. | 62/114 X |

*Primary Examiner*—Lloyd L. King

*Attorney, Agent, or Firm*—Millen & White

[57] ABSTRACT

Process for producing cold and/or heat by using a non-azeotropic mixture of fluids in a cycle with ejector. The working fluid is condensed (C), then separated in two fractions (2 and 7); the first fraction (2) is evaporated (EV) at relatively low temperature, the second fraction (7) is evaporated (B) at a relatively high temperature, and then the two vaporized fractions pass through an ejector (E) and are fed back to condenser (C). This process can be used for domestic heating or for refrigeration.

9 Claims, 4 Drawing Figures

PROCESS FOR PRODUCING COLD AND/OR HEAT BY USING A NON-AZEOTROPIC MIXTURE OF FLUIDS IN A CYCLE WITH EJECTOR

This invention relates to a process for producing cold and/or heat from a heat source, by using a new working fluid in a cycle comprising an ejector (ejection means).

This process can be used for heating buildings or for refrigeration.

BACKGROUND OF THE INVENTION

The principle of the cycle with ejector, as known in the prior art, is briefly summarized hereinafter.

A driving fluid at high pressure and high temperature, supplied from a boiler, is expanded in the first section of an ejector. The expansion results in a speeding up of said fluid which may thus drive along therewith a second fluid flowing from an evaporator. Both fluids are admixed and penetrate the second section of the ejector. By reducing their velocity or kinetic energy, their pressure is increased up to that prevailing in the condenser. A heat source supplies heat at high temperature BT to the boiler, a second heat source, which may be the external surrounding medium, supplies heat at low temperature (ET) to the evaporator, so that the sum of the two heat supplies is recoverable at the condenser at an intermediary temperature CT. The fluid flowing out from the condenser is partly expanded and again evaporated at temperature ET, and partly increased in pressure through a pump and vaporized in the boiler at temperature BT.

SUMMARY OF THE INVENTION

An object of this invention is the use, in a cycle with ejection of a working fluid (hereinafter called F) composed of a non-azeotropic mixture, of at least two chemically inert fluids, capable of evaporating but not to crystallizing under the operating conditions of the process.

The process is characterized by the steps of :

(a) subjecting a working fluid (F), in gaseous state, to a condensation step under a pressure (CP) by transferring the condensation heat of fluid (F) to an external fluid, said fluid (F) comprising a non-azeotropic mixture of 5-95 %, in molar proportion, of a first constituent and 95-5 %, in molar proportion, of a second constituent miscible, in the liquid phase, with the first constituent, said constituents of the mixture being chemically different and capable of evaporating but not to crystallizing under the operating conditions of the process, (b) subjecting the resultant condensate to a pressure decrease and supplying heat thereto under said decreased pressure (EP) so as to partially evaporate it and separating the vaporized fraction (F1) from the remaining liquid phase fraction (F2), (c) increasing the pressure of fraction (F2) up to a pressure (BP) higher than pressure (CP) of step (a) and supplying heat to said fraction (F2) so as to obtain it (F2) in vapor phase, and (d) subjecting the vapor phase fraction (F2), obtained in step (c), to expansion through ejection means, thereby driving along with said expanded fraction the vapor phase fraction (F1) obtained from step (b), so as to mix said two fractions and reconstitute the fluid (F) in gaseous state, at the pressure (CP) of step (a).

The difference between the normal boiling temperatures of said two constituents is, for example, from 10° to 150° C.

Fractions F1 and F2 may respectively amount to 5-95% and 95-5% by mole of mixture (F), preferably respectively 20-80% and 80-20%.

Preferably, one of the constituents is water (80-95% by mole) and the other constituent (5-20% by mole) may be, for example, an alcohol, a ketone, ammonia, an amine or an amide or any other compound soluble in water whose normal boiling point ranges from 100° to −50° C. Another mixture which can be used comprises two separate halogenated hydrocarbons or a hydrocarbon and a halogenated hydrocarbon.

The present process is operable during a long period without intervention, as for example in domestic heating. As a matter of fact, a mixture, for example water-alcohol, provides simultaneously for the thermal stability necessary to a long-run operation, a low pressure acceptable in the evaporator, no corrosion, no liability of crystallization and a mechanical simplicity necessary for a long operating time. As a matter of fact, fluid (F), for example when one of the constituents is water, has the first advantage of being a mixture of chemically and thermally stable fluids within the temperature range between that of the evaporator, for example 0° C. to −5° C. and that of the boiler, for example 150°-180° C.

The pressure increase at the evaporator is advantageous as compared to a system using water as single working fluid. As a matter of fact, at the low temperature of the evaporator (about 0° C.) the saturation vapor pressure of water is very low (near 600 Pascals). Water, when used alone, thus requires systems whose volume must be of large size in order to avoid any pressure drop between the different elements. The increase of the working pressure makes possible to reduce the volume of the system and results in a lower investment cost.

The possibility of selecting non-corrosive mixtures, such for example as water-ammonia, water-alcohol or water-ketone, is another advantage. Usual building materials such as carbon steel or copper may be used, depending on the selected fluids, instead of stainless steel or coatings of costly materials used as protective agents against corrosion.

When one of the constituents is water, another advantage consists in using a working fluid whose thermodynamic properties are close to those of water, when the latter is the main constituent, but without liability of crystallization.

In operation as a heat-pump, it is preferred to use mixtures whose crystallization point is lower than −5° C., the temperature which is usual at the evaporator when the surrounding air is at a temperature close to 0° C.

This is a conclusive advantage over the adsorption systems using the pair water-lithium bromide, wherein the working fluid is pure water, thus limiting in 0° C. the lower operating temperature of evaporator.

Another advantage of the present system is the mechanical simplicity of the ejector which provides for a compression of the working fluid without any moving mechanical part such as those used in the conventional heat pumps with membrane-piston- or screw-compressors. The compressor is often responsible for less reliability of the whole system and moreover requires a special lubrication which may disturb the balance of the working fluids.

Still another advantage consists in the reduction of the thermodynamic irreversibilities of the system by the use of the proposed type of working fluid. Such a fluid type has the property of passing from the liquid state to the vapor state (or the reverse) with temperature variations when the pressure remains substantially constant. Accordingly, it is possible, by counter-current heat exchange between the fluids, to reduce their thermal difference.

All of these advantages are simultaneously obtained according to the present process.

Figure 1:
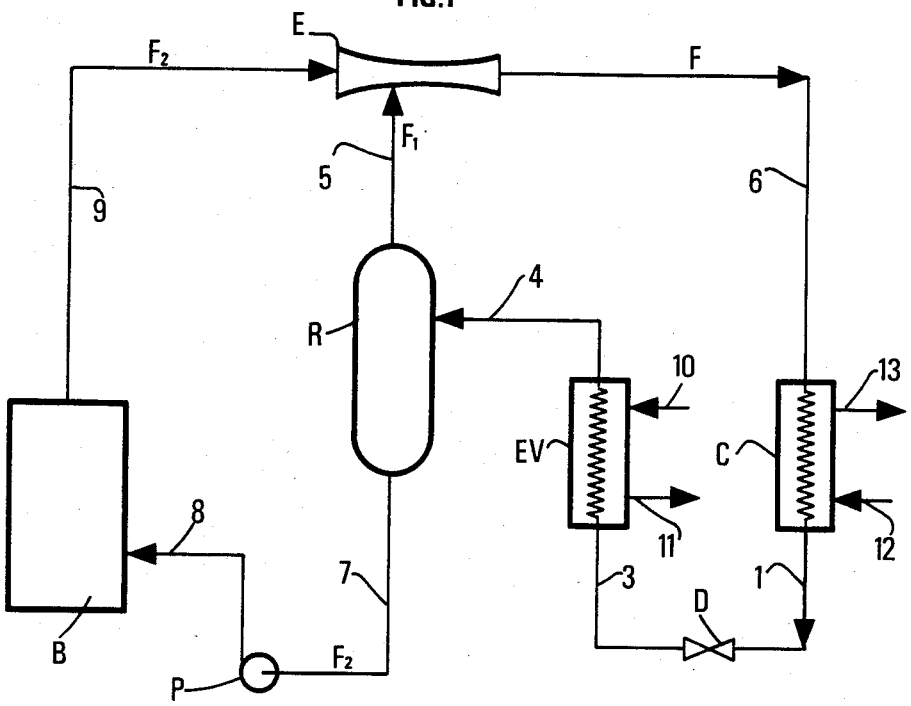
FIGS. 1 to 4 of the accompanying drawings illustrate various embodiments of the invention.

A first embodiment, illustrated in FIG. 1, is described hereinafter.

The working fluid F, consisting of a non-azeotropic mixture of water with a product soluble in water, flows out through line 1 from condenser (C), in liquid state, at a temperature CT and a pressure CP.

The fluid F is conveyed through line 1 to expansion means D where the pressure of fluid F is decreased to EP. Vaporization may optionally begin in line 3. The fluid F is partially vaporized in evaporator Ev by heat supply from an external fluid, fed through line 10 and discharged through line 11. A counter-current flow of internal fluid F and external fluid is preferable in order to increase the energy performances of the cycle. However, the evaporation of the working fluid F may also be achieved in an evaporator of another type, for example an air evaporator with cross-streams of fluids. The fluid F, flowing out through line 4, is fractionated in drum R into a vapor fraction F1 and a liquid fraction F2, respectively discharged through lines 5 and 7.

According to the known operating principle of the ejector, the gaseous fluid F1, introduced through line 5, is sucked by the gaseous fluid F2 at high pressure from line 9, admixed with the latter and flows out through line 6 at a pressure intermediary between those prevailing in lines 9 and 5 respectively. As a matter of fact, fluid F1, introduced through line 5 is compressed, the compression work resulting from the expansion of fluid F2, introduced through line 9. The resultant mixture (line 6) is at a pressure CP higher than EP.

In line 6, the fluid F, whose flow-rate by weight and total composition are the same as those of fluid F flowing out of condenser C, is in vapor phase. By heat exchange with an external fluid circulating between lines 12 and 13, the heat supplied to the system at evaporator EV and at boiler B is transferred to the external fluid by condensation and cooling of the working fluid. This working fluid F is composed of a non-azeotropic mixture of fluids; the condensation is not isothermal; and a counter-current circulation is preferable during the heat-exchange with the external fluid.

The cycle is completed by the circulation, through lines 7 and 8 and pump P, of the fraction F2 of fluid F, flowing out of drum R.

This fluid F2, in the liquid state, is fed to boiler B at a pressure BP higher than CP and at a high temperature BT providing for the conversion of fluid F2 to a gaseous phase, supplied through line 9 to the ejector.

The liquid phase recovered in tank R is, according to the thermodynamic laws, in temperature and pressure balance with the conditions of evaporator output. This, in particular, means that the liquid phase is enriched with the less volatile constituent of the non-azeotropic mixture forming the working fluid. The boiler temperature required to vaporize the driving fluid F2 is higher, thus resulting in an increase of the thermodynamic yield of the system.

Figure 2:
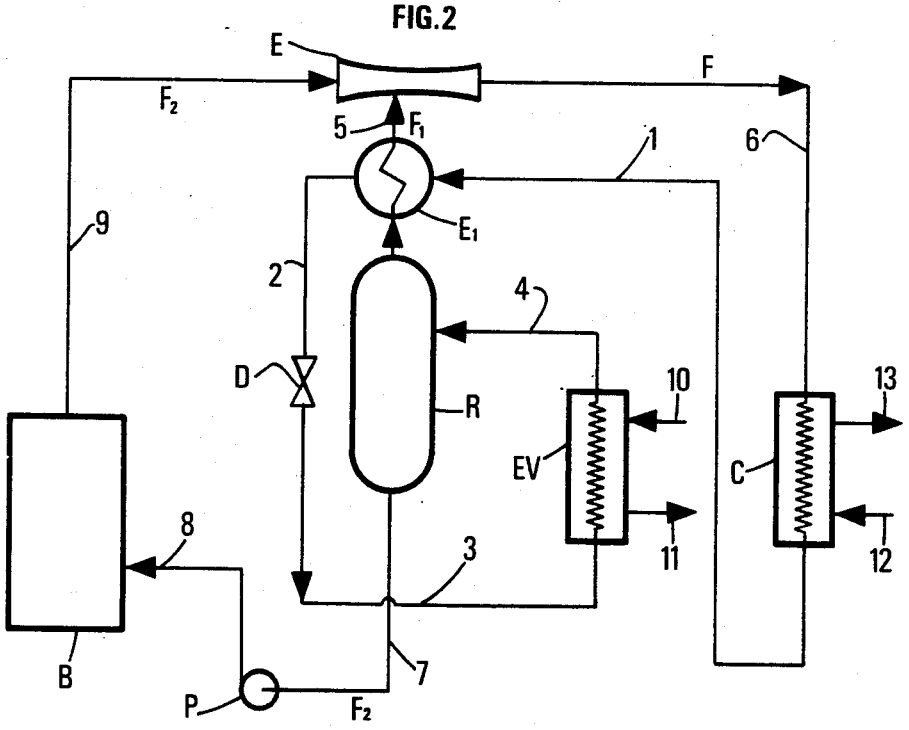

Another embodiment (shown in FIG. 2) is characterized by the simultaneous addition of a tank R at the output of the evaporator (for the separation of the liquid and vapor phases) and of an exchanger E1 on line 1 for the heat transfer between the hot liquid flowing from the condenser and the cold vapor flowing from tank R.

Figure 3:
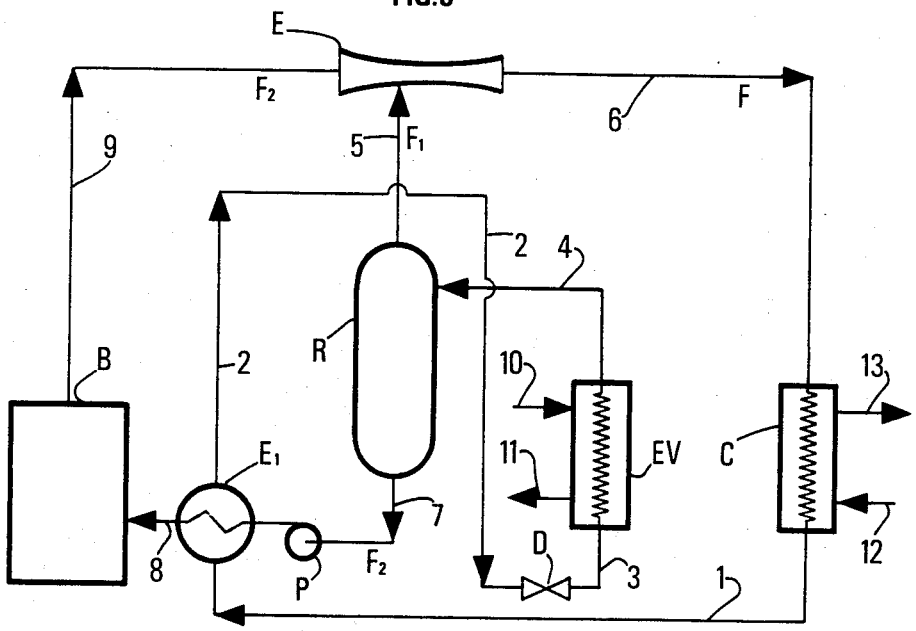

Another embodiment (shown in FIG. 3) is characterized by the simultaneous addition of tank R at the output of the evaporator and of exchanger E1 for the heat transfer between the liquid flowing from the condenser and the cold liquid phase flowing from tank R and brought to high pressure by pump P.

Figure 4:
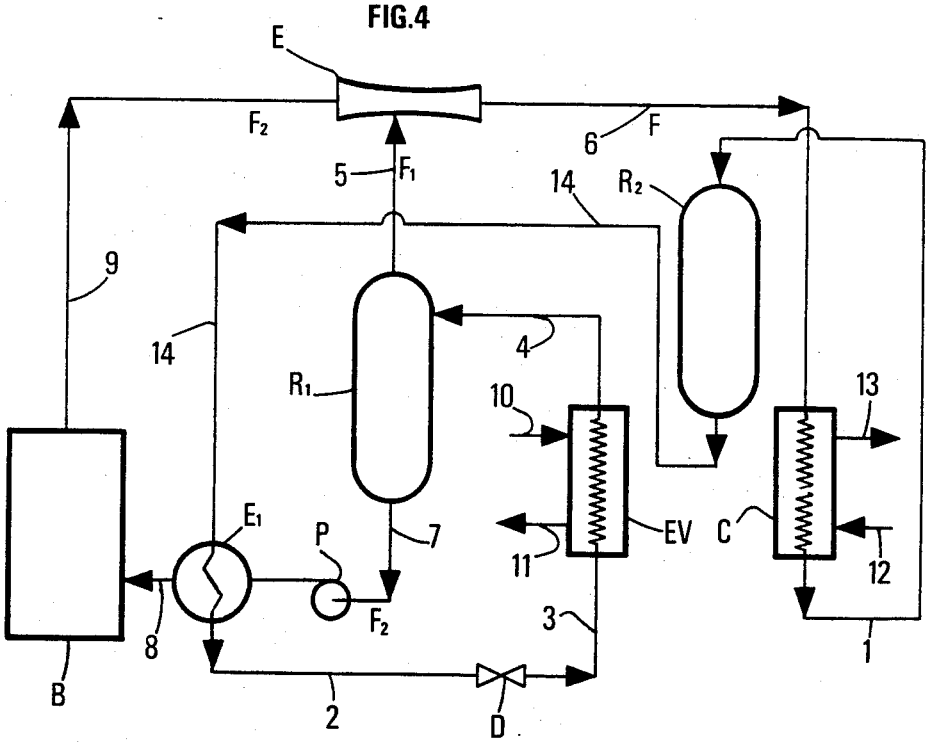

FIG. 4 illustrates the principle of an embodiment characterized by the addition of a tank R1 at the output of the evaporator, of a tank R2 at the output of the condenser and of an exchanger E1 for sub-cooling the condensate flowing out of the condenser.

Such an embodiment provides in particular for a self-adaptation of the system to compulsory operating conditions of variable power and temperature level. The compositions of the liquid and gaseous phases in the two tanks R1 and R2 are in fact dependent on the internal temperature, pressure and volume conditions as well as on the maintenance of the weight and volume conditions as well as on the maintenance of the weight of constituents initially introduced in the system.

What is claimed as the invention is :

1. A process for producing cold and/or heat by using a working fluid (F), characterized by the steps of :

(a) subjecting a working fluid (F), in gaseous state, to condensation under a pressure (CP) by transferring the condensation heat of fluid (F) to an external fluid, said fluid (F) comprising a non-azeotropic mixture of 5–95 %, in molar proportion, of a first constituent and 95–5 %, in molar proportion, of a second constituent miscible in liquid phase with the first consituent the constituents of said mixture being chemically different and capable of evaporating but not to crystallizing under the operating conditions of the process, (b) subjecting the resultant condensate to a pressure decrease and supplying heat thereto under said decreased pressure (EP) so as to partly evaporate it and separating the vaporized fraction (F1) from the liquid phase remaining fraction (F2), (c) increasing the pressure of fraction (F2) up to a pressure (BP) higher than the pressure (CP) of step (a) and supplying heat to said fraction (F2), so as to obtain it (F2) in vapor phase, and (d) subjecting the vapor phase fraction (F2) obtained in step (c) to expansion through ejection means and driving along with said expanded fraction the vapor phase fraction (F1) obtained from step (b), so as to admix said two fractions and to reconstitute the fluid (F) in gaseous state at the pressure (CP) of step (a).

2. A process according to claim 1, wherein the liquid phase fraction (F2) at pressure (BP), before being subjected to vaporization in step (c), is contacted in heat exchange conditions with the liquid phase resulting from the condensation of fluid (F), before decreasing the pressure thereof.

3. A process according to claim 1 , wherein the vaporized fraction (F1), before being fed to the ejection means, is contacted in heat exchange conditions with the liquid phase resulting from the condensation of fluid (F), before decreasing the pressure thereof.

4. A process according to claim 1, comprising means for keeping apart a portion of the liquid phase obtained by condensation of fluid (F).

5. A process according to claim 1, wherein the working fluid (F) consists of a non-azeotropic mixture containing (in molar proportion) 80–95 % of water and 5–20% of at least one compound soluble in water whose normal boiling point ranges from 100° C. to −50° C.

6. A process according to claim 1, wherein the working fluid (F) consists of a mixture of water with at least one alcohol.

7. A process according to claim 1, wherein the working fluid (F) consists of a mixture of water with ammonia.

8. A process according to claim 1, wherein the working fluid (F) consists of a mixture of water with at least one ketone.

9. A process according to claim 1, wherein fractions (F1) and (F2) respectively amount to 20–80% and 80–20% by mole of mixture (F).

* * * * *